United States Patent [19]

Richlin et al.

[11] Patent Number: 4,998,992

[45] Date of Patent: Mar. 12, 1991

[54] WIG STAND WITH VENTILATION CHANNELS

[76] Inventors: Milton Richlin, 829 Finch Dr., Bensalem, Pa. 19020; Aloysius Dubeck, 401 Manor Dr., Hampton, N.J. 08837

[21] Appl. No.: 501,288

[22] Filed: Mar. 30, 1990

[51] Int. Cl.[5] ..... A47F 8/00

[52] U.S. Cl. ..... 223/66; 223/84; 223/120; D28/92; 132/53; 206/8; 206/9

[58] Field of Search ..... 223/66, 84, 120; D28/92, 93; 132/53, 54, 55, 56; 206/8, 9

[56] References Cited

U.S. PATENT DOCUMENTS

| | | | |
|---|---|---|---|
| D. 226,246 | 1/1973 | Duecker | D28/93 |
| D. 230,777 | 3/1974 | Imai | D28/93 |
| 3,254,757 | 6/1966 | Raskin | 206/8 |
| 3,342,478 | 9/1967 | Shaw et al. | 206/8 |
| 3,462,050 | 8/1969 | Hensley | 223/66 |
| 3,468,499 | 9/1969 | Rodgers | 223/66 |
| 3,843,031 | 10/1974 | Oh et al. | 223/66 |
| 3,897,892 | 8/1975 | Waters | 223/66 |
| 4,422,230 | 12/1983 | Nemoto | 29/434 |

*Primary Examiner*—Werner H. Schroeder
*Assistant Examiner*—Bibhu Mohanty
*Attorney, Agent, or Firm*—Paul Lipsitz

[57] ABSTRACT

An improved wig stand made of a compressible, open cell foam formed to resemble the shape of the human head and having a substantially flat base and a plurality of channels sufficient to ventilate the area under a wig resting on the wig stand.

6 Claims, 2 Drawing Sheets

WIG STAND WITH VENTILATION CHANNELS

This invention relates to an improved wig stand which embodies several important advantages over previous wig stands, particularly, portability, washability, and ability to aid drying and dissipate odors.

BACKGROUND OF THE INVENTION

Wig stands for both men's and women's wigs have been in use for a very long time and serve numerous purposes. A wig or hairpiece is normally placed on a wig stand overnight to help maintain the shape of the wig and to air out. Airing out is important, because the wig frequently will become odoriferous during use and it is desirable that such odors be removed from the wig. A wig stand is also used to groom the wig and it is affixed to the wig stand with pins in order to keep it in place as it is being combed and brushed.

In recent years, wig stands have been made of rigid expanded polystyrene (commonly called styrofoam) shaped as a head. Such wig stands, however, have numerous disadvantages. For example, a polystyrene wig stand does not dissipate the odors developed during a day's use of the wig. In addition, the double-backed adhesive tape used in a man's wig to hold the wig in place during use can develop a fairly strong bond with the polystyrene wig stand when the wig is place on it and this makes it necessary to frequently retape the inside of the wig. Still another disadvantage of the polystyrene wig stand is that, because of its rather large size, it is difficult to transport during trips that the wig wearer may take, since it will not readily fit into a conventional suitcase.

The improved wig stand of this invention overcomes these disadvantages and also provides additional benefits for a wig wearer.

BRIEF DESCRIPTION OF THE INVENTION

The improved wig stand of this invention comprises a molded wig stand made of a low density (i.e., compressible) open cell foam material and which is further characterized by having a plurality of channels running vertically from near or at the base of the wig stand up to the top of the stand and, preferably, over the domed top of the stand.

DISCUSSION OF PRIOR ART

U.S. Pat. No. 3,468,499 discloses a wig stand made of expanded polystyrene.

U.S. Pat. No. 3,843,031 discloses the use of mannequin heads of polymeric materials, such as polystyrene, thin sheets of plastic and other synthetic materials. Such mannequin heads, are used for displaying wigs, are rigid and are not adaptable to wig stands used by wig wearers.

U.S. Pat. No. 4,422,230 discloses a wig base for setting a female wig thereon made of a flexible synthetic resin sheet.

DETAILED DESCRIPTION OF THE INVENTION

As indicated above, the wig stand of the invention is made of a compressible open cell foam material and, preferably, a polyurethane-ether open cell foam will be used. The wig stand will be produced, preferably, by a molding operation, although it may be fabricated by cutting an appropriately sized piece of foam to the desired shape and dimensions. When making the wig stand by a molding operation, it is desirable to employ a mold release agent on the surface of the mold, thereby producing a very smooth surface on the wig stand. Because of the air-filled nature of the foam, there is no tendency for the wig tape to bond to the wig stand. Such molding operations with compressible open cell foam material are well known in the art and may employ either the one-shot or pre-polymer process (see the Kirk-Othmer Chemical Encyclopedia of Chemical Technology, 2nd. Ed., Vol. 9; chapter entitled Foamed Plastics, pages 857–855, 863, and 869–870). In general, the ingredients for making the foam are poured into an open cavity mold and after mixing for about three seconds, the mold is closed and heated to about 110° F. for ten to twelve minutes. The molded piece is then ejected and allowed to cool.

The wig stand of the invention will approximate the dimensions of a human head, being out five inches wide, about seven inches long and about five inches high. In order to further describe the wig stand reference is now made to the drawings.

Figure 3:
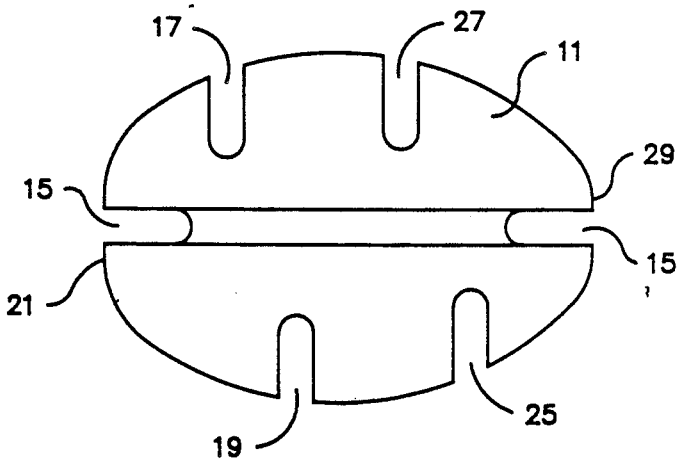
FIG. 3 is a top view of a preferred embodiment showing a channel running over the top of the wig stand.
Figure 1:
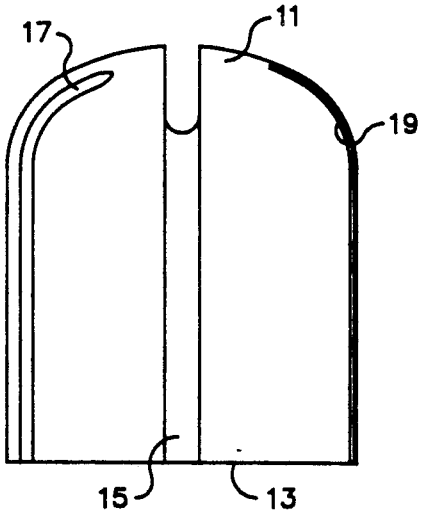
FIG. 1 is a front view of the wig stand showing channels molded into the wig stand.
Figure 2:
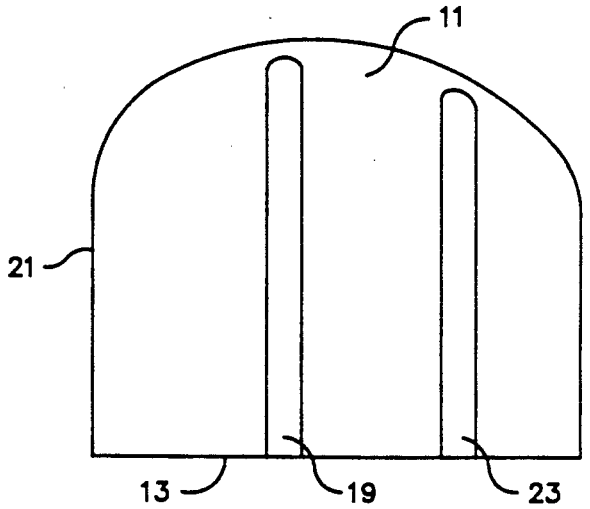
FIG. 2 is a side view showing channels on the side of the wig stand.
Figure 4:
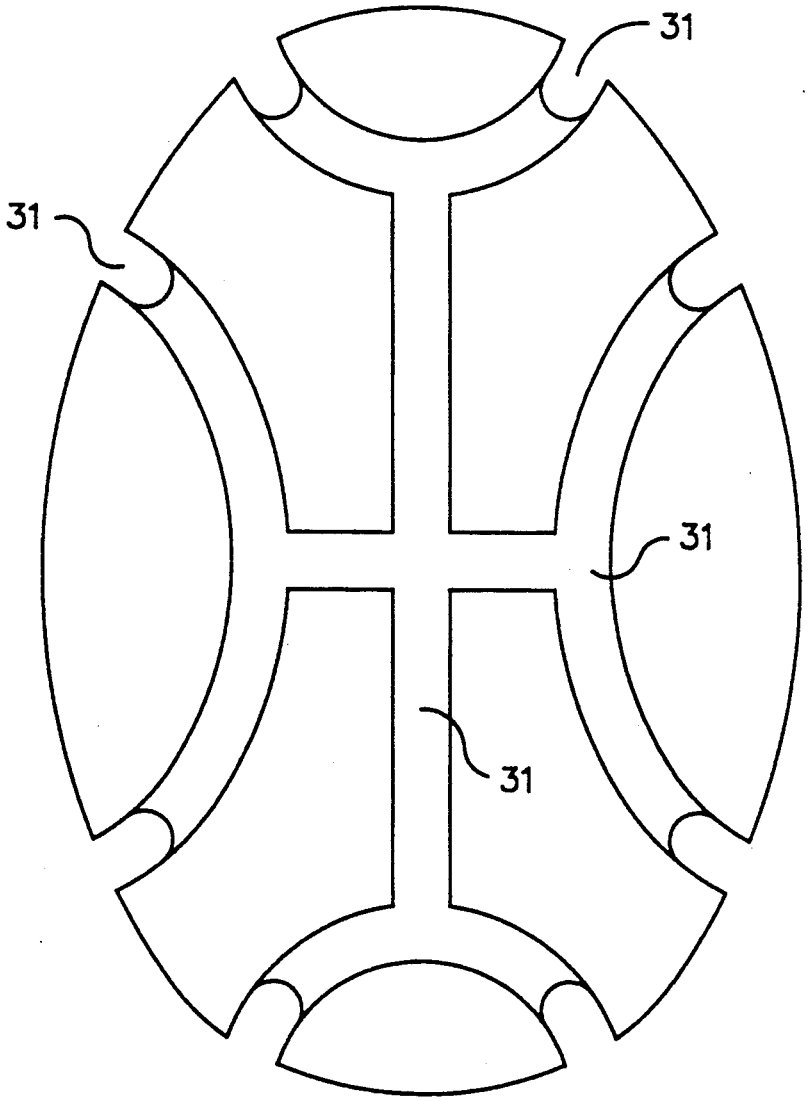
FIG. 4 is a top view of a preferred embodiment of the invention.

FIG. 1, which is a frontal view, the wig stand which is in the approximate shape of a head is shown generally as 11. The base area 13 is substantially flat so that the wig stand may rest on a horizontal surface. A central channel 15 extends from the front of the base 13 upwardly to and across the top of the wig stand and down to the base 13 on the opposite side 29. This is seen more clearly in the top view drawing, FIG. 3, where the front section 21 and the rear section 29 of the head-shaped wig stand are identified. Additional side channels 17 and 19 are also seen in side view in FIG. 1, channel 19 being seen better in FIG. 2, where a front section of the wig stand is shown as 21. Additional channels 25 and 27 are seen in FIG. 3 which is a top view of the wig stand. FIG. 4 is a top view of a preferred embodiment of the invention wherein the channels 31 are all interconnected and are arranged symmetrically. This arrangement provides a more aesthetic appearance for the wig stand.

The channels in the wig stand may vary in size and length, but the wig stand will be characterized by having a plurality of channels, preferably from about four to about six, with one or more extending from a point at or near the base on one side, over the top, and down to or near the base on the other side. The width of the channels may also vary, but will generally be about one-half inch in width and the channels will be from about two to about three inches apart. These channels in the wig stand will be sufficient in number, size and position so as to serve to ventilate the area beneath the wig as it rests on the stand. This ventilation together with the open cell structure of the foam enables any odor the wig may have to dissipate during the night as it rests on the wig stand. This aeration feature is also of value when a wet or damp wig, after washing, is placed on the stand as it permits faster drying than wig stands used heretofore.

It will be understood that the number and position of the channels may vary, it being only necessary to have sufficient to provide adequate aeration for the wig on the stand.

As indicated above, the preferred wig stand of the invention will be made of an open cell polyurethane foam. Such foams are well known and are exemplified by polyurethane-ether and polyurethane-ester type foams. In a further preferred embodiment of the invention, the density of such foam will be about 2.8 to 3.2 pounds per cubic foot. Such a foam density will give adequate structural stability to the wig stand and will also provide the compressibility and resilience necessary to enable the wig stand to be compressed into a smaller volume for traveling, making it amenable to packing into a suitcase or other travel case. Upon removal from the travel case, the compressed wig stand will return to its head-like shape and be ready for use.

Although the wig stand is made of a compressible foam, it will effectively receive pins to keep the wig in place on the wig stand for grooming. Furthermore, if necessary, the wig stand of the invention may be washed and dried without harm.

It will be understood that numberous changes and variations may be made to the improved wig stand without departing from the spirit and scope of the invention.

We claim:

1. A wig stand comprising a compressible, open cell foam formed to resemble the shape of the human head, said wig stand having a substantially flat base and having a plurality of channels sufficient to ventilate the area under a wig resting on said wig stand.

2. The wig stand of claim 1 wherein the compressible foam is a polyurethane-ether foam.

3. The wig stand of claim 1 wherein the compressible foam is a polyurethane-ester foam.

4. The wig stand of claim 2 wherein at least one channel extends from a point adjacent the base section of said wig stand, over the top and adjacent the base section on the other side.

5. The wig stand of claim 4 wherein the density of the foam is from about 2.8 to about 3.2 pounds per cubic foot.

6. The wig stand of claim 5 wherein the channels are symmetrically arranged.

* * * * *